United States Patent [19]

Fromson et al.

[11] 4,285,276

[45] Aug. 25, 1981

[54] METHOD FOR PRINTING EMPLOYING LITHOGRAPHIC FOUNTAIN DAMPENING SOLUTION

[75] Inventors: Howard A. Fromson, 15 Rogues Ridge Rd., Weston, Conn. 06066; Robert F. Gracia, Scituate, Mass.

[73] Assignee: Howard A. Fromson, Weston, Conn.

[21] Appl. No.: 139,490

[22] Filed: Apr. 11, 1980

Related U.S. Application Data

[63] Continuation of Ser. No. 960,894, Nov. 15, 1978, abandoned, which is a continuation-in-part of Ser. No. 792,424, Apr. 29, 1977, abandoned.

[51] Int. Cl.[3] ..... B41M 1/06

[52] U.S. Cl. ..... 101/451; 101/465; 106/2

[58] Field of Search ..... 106/2, 135; 101/451, 101/465

[56] References Cited

U.S. PATENT DOCUMENTS

| | | | |
|---|---|---|---|
| 2,044,156 | 6/1936 | Dietz | 106/2 |
| 2,334,098 | 11/1943 | Hubbard | 106/135 |
| 2,387,056 | 10/1945 | Buck et al. | 106/135 |
| 3,257,941 | 6/1966 | Wolfson et al. | 106/2 |
| 3,289,577 | 12/1966 | Uhlig | 106/2 |
| 3,354,824 | 11/1967 | Griffith et al. | 106/2 |
| 3,522,062 | 7/1970 | Shimizu et al. | 106/2 |
| 3,532,599 | 10/1970 | Cooperman et al. | 101/424 |
| 3,557,002 | 1/1971 | McCarty | 424/94 |
| 3,620,737 | 11/1971 | Etter et al. | 101/465 |
| 3,625,715 | 12/1971 | Nasca | 106/2 |
| 3,681,197 | 8/1972 | Smith | 424/94 |
| 3,687,694 | 8/1972 | Van Dusen | 106/2 |
| 3,775,135 | 11/1973 | Harper | 106/2 |
| 3,813,342 | 5/1974 | Cooperman | 195/63 |
| 3,829,319 | 8/1974 | Suzuki et al. | 106/2 |
| 3,877,374 | 4/1975 | Cook | 102/38 |

OTHER PUBLICATIONS

Hawley, *The Condensed Chem. Dict.,* 8th Ed., p. 422.

*Primary Examiner*—Lorenzo B. Hayes

*Attorney, Agent, or Firm*—Sprung, Felfe, Horn, Lynch & Kramer

[57] ABSTRACT

Method for lithographic printing wherein a lithographic printing plate having oleophilic and hydrophilic areas on the printing surface of the plate is contacted with ink and an aqueous fountain solution during printing. An aqueous solution comprising an enzyme is used as the fountain solution.

5 Claims, No Drawings

METHOD FOR PRINTING EMPLOYING LITHOGRAPHIC FOUNTAIN DAMPENING SOLUTION

RELATED APPLICATION

This is a continuation of application Ser. No. 960,894 filed 11/15/78, now abandoned, which is a CIP of application Ser. No. 792,424, filed 4/29/77, now abandoned.

BACKGROUND

This invention relates to lithographic printing and more particularly to improving the printing characteristics of lithographic printing plates.

Lithographic printing is an ancient art based on the principle of oil and water immiscibility. The art has been greatly advanced by the use of anodized aluminum substrates on which a printing surface is formed using photochemicals and photopolymers. The printing surface is made up of an image area which is oleophilic and hydrophobic (ink attracting and water repelling) and a nonprinting or background area which is hydrophilic and oleophobic (water attracting and ink repelling).

Successful printing requires a delicate balance between ink and water. Water has been used in spray and other, types of dampening systems; but with the conventional system using molleton on cloth covers, the dampeners grease rapidly when only plain water is used in the fountain. Greasing of the dampeners causes poor wetting as well as spreading of the ink into non-image areas, especially in halftones and reverse lettering. The use of solutions containing gum arabic or cellulose gum as a fountain solution greatly reduces this tendency of dampeners to grease. Greasing of cloth dampeners, however, always occurs to some extent. The addition of a small amount of acid—like phosphoric acid—and salts—like nitrates, phosphates and/or bichromates—to the fountain solution seems to overcome greasing and promote better wetting.

There are a great number and variety of fountain solution formulas. For some unknown reason, fountain solutions do not work well on aluminum plates unless they contain a nitrate salt. While bichromates are undesirable in fountain solutions because of their tendency to cause dermatitis, they are of help in preventing the stripping of steel rollers on the press. With the introduction of hard rubber and copper rollers and copperizing treatments for steel, this stripping tendency has decreased considerably and many plates now are operating successfully with solutions of the zinc nitrate, phosphoric acid and either gum arabic or cellulose gum type.

Typical fountain solution compositions for lithographic printing are described in the following U.S. patents:

| | | |
|---|---|---|
| Wolfson et al | 3,257,941 | 1966 |
| Uhlig | 3,289,577 | 1966 |
| Griffith et al | 3,354,824 | 1967 |
| Bondurant et al | 3,398,002 | 1968 |
| Shimizu | 3,522,062 | 1970 |
| Nasca | 3,625,715 | 1971 |
| Van Dusen, Jr. | 3,687,694 | 1972 |
| Harper | 3,775,135 | 1973 |
| Suzuki | 3,829,319 | 1974 |
| Leeds | 3,877,374 | 1975 |

Present day fountain solutions, however, are expensive and present disposal problems because of pollution laws. This is especially acute with respect to solutions containing acids, heavy metal salts and alcohols.

Another problem is paper waste and with ever-increasing costs, what used to be ignored, is now a prime area of concern. Each time a press is started, acceptable printing quality must wait until the press is in balance. In the case of newspapers, it is not uncommon to discard the first 200–500 newspapers on each start-up of the press. Such presses are often stopped for edition changes and web breaks. These interruptions substantially increase the day in day out paper waste.

The use of enzymes to remove portions of differentially hardened layers on lithographic plates is suggested by Etter in U.S. Pat. No. 3,620,737. This relates to preparing the plates and the enzyme action must be stopped before the plates are ready for printing. While Etter suggests a pre-printing treatment, Cooperman in U.S. Pat. Nos. 3,532, 599 and 3,813,342 suggests a post-printing treatment to remove accumulated gum deposits using specific enzymes. The use of a protein or a proteinaceous material during actual printing is not described or suggested in the prior art.

SUMMARY

The present invention improves lithographic printing, makes it possible to eliminate or reduce the amount of additives heretofore used in lithographic fountain solutions and reduces paper waste.

The invention provides an improvement in lithographic printing wherein a lithographic printing plate having oleophilic and hydrophilic areas on the printing surface of the plate is contacted with an aqueous fountain solution during printing. The improvement of the invention comprises using an aqueous solution containing a proteinaceous material as the fountain solution.

Proteins are made up of polypeptide chains which in turn are made up of amino acids linked head to tail in infinite variations. The utility of these materials in fountain solutions is believed to be due to their unusual chemical make-up. These materials are amphoteric and can be positively or negatively charged depending on the pH of the solution. Some are soluble under acid conditions, some at neutraility, and some under basic conditions. Because of their structure, they are very polar substances and, therefore, water loving. Their polarity also gives them the abilty to adhere to charged substances with extreme tenacity.

DESCRIPTION

Water soluble proteinaceous materials are suitable for use in the present invention. These include water soluble amino acids such as glycine, L-asparatic acid, L-glutamic acid, L-alanine, L-leucine, L-valine, and L-cystine, water soluble polypeptides such as polypeptide-LSN (Stepan Chem. Co.) Procote-180 (Ralston-Purina) and BAN (Novo Labs) and water soluble, active and inactive enzymes of the hydrolase type such as amylase, lipase, maltase, papain, pepsin, protease, sucrase, trypsin, diastase, rapidase, chymotrypsin A, acetylcholinesterase and the like.

The proteinaceous materials are used in an amount which is effective for obtaining the desired results. Generally an amount in the range of 0.05 to 5% by weight will be sufficient and optimum results are attained when using amount of less than 1% by weight, e.g. 0.1 to 0.5% by weight. The fountain solution can also contain other substances such as water soluble polymers such as polyox or polyvinyl alcohol (films of which can be used to package the proteinaceous materials in dry form) which improve the action of the proteinaceous materials.

EXAMPLE 1

An aqueous solution of 0.5% pepsin is used as the fountain solution in a conventional offset lithographic press. The printing quality is excellent and 30–50% less fountain solution is used in comparison to printing using a conventional fountain solution. It is also possible to change the type of plate without having to adjust the fountain solution/ink balance. Heretofor, each plate change meant having to adjust or replace the fountain solution.

Thus, according to the invention, the amount of fountain solution can be reduced by 30–50% and because less moisture is present the ink sets quicker and is more intense.

EXAMPLE 2

Example 1 is duplicated using 0.5% aqueous lipase with the same beneficial results.

EXAMPLE 3

Example 1 is duplicated using 0.5% aqueous protease with the same beneficial results.

EXAMPLE 4

Example 1 is duplicated using 0.5% aqueous amylase with the same beneficial results.

EXAMPLE 5

Example 1 is duplicated using 0.5% aqueous diastase with the same beneficial results.

EXAMPLE 6

Example 1 is duplicated using 0.5% aqueous papain with the same beneficial results.

EXAMPLE 7

Example 1 is duplicated using 0.5% aqueous rapidase with the same beneficial results.

EXAMPLE 8

Two enzymes, amylase (Aquazyme 120L-Novo Labs) and the protease (Alcalse 0.6L-Novo Labs) are used in active and inactive forms. The inactive forms are made by two methods: pH inactivation and heat inactivation. These protein materials are incorporated in a fountain solution at a concentration of approximately 0.1–0.2%. A test is run on a Harris sheet-fed press. Roll-ups and ink black-out tests are performed with these active and inactive proteins. No difference can be observed in the quality of the print or the quickness of roll-up both on start-up and after black-out. These tests demonstrate improvement with various proteins according to the invention.

The invention can also be used to advantage in a di-litho operation where letterpress machines are converted to lithographic printing with direct contact between the plate and the paper being printed.

EXAMPLE 9

A test is run with a protein material designated BAN (amylase) and supplied by Novo Labs, Denmark. A 120 grams of BAN are packed in film bags with Quik Sol-P supplied by Polymer Films, Inc., Rockville, Connecticut. These bags are water soluble and .ontain polyoxyethylene polymers (Polyox - Union Carbide). One bag containing BAN is placed into a 30-gallon (water) sump of a Goss Metro offset press. The bag and its entire contents dissolve quickly. A 50,000 edition newspaper is run using the fountain solution. High quality color and black and white prints of unusual clarity resulted.

EXAMPLE 10

A test is made similar to Example 9 except the Quik Sol-P bags were not used. Instead, one gram of Polyox WSR-205 and 120 grams of BAN were used with similar results.

EXAMPLE 11

Example 10 is repeated using Polyox WSR N-3000 with similar results.

EXAMPLE 12

A fountain solution is prepared using 2 grams per liter of L-lysine HCl provided by Ajinomoto Company, Inc., Tokyo, Japan. The fountain solution is used on a Harris sheet-fed press. Roll-up tests and black-out tests are run. The print quality and ease of clean-up were excellent.

EXAMPLE 13

Example 12 is repeated using other amino acids, namely, L-asparatic acid, glycine, L-glutamic acid, L-alanine, L-leucine, L-valine, L-cystine. All materials were obtained from Ajinomoto, Tokyo, Japan and results are similar to Example 12.

EXAMPLE 14

A fountain solution is prepared using Quik Sol-P bags containing 120 grams of polypeptide LSN anhydrous, which is hydrolyzed animal protein sold by Stepan Chemical Company, Northfield, Illinois. One bag containing polypeptide is added to 30 gallons of water in the sump of a Goss-Metro offset press. 50,000 copies of a daily newspaper are run. Quick roll-up, minimum paper waste, and good quality color and black and white images result.

EXAMPLE 15

A fountain solution similar to Example 9 is prepared using BAN and a water soluble Quik Sol "A" bag. Similar results were obtained on an offset press. Quik Sol "A" contains polyvinyl alcohol.

EXAMPLE 16

A 0.1% solution of a vegetable protein (Pro-cote polymers-Ralston Purina) is prepared. These materials are composed of amino acids, namely, the $\alpha$-amino carboxylic acids whose polypeptide chains also function as fountain solution additives. The fountain solution is placed on a Harris sheet-fed press. Roll-up and black-out tests are made with results as in Example 9.

EXAMPLE 17

A fountain solution containing protease is tested under controlled conditions sanctioned by the ANPA. The tests are run under the following conditions:

Goss Perfecting Urbanite Press
Flint Fountain Solution (V2 0 2 0-control)
Flint Offset Black Ink
Standard Newspaper Print
New Molleton Socks on Dampening Rollers Procedure for start-ups was as follows:

1. Folder disengaged
2. Infeed disengaged
3. Water feed on
4. Ink feed on
5. Water form roller down
6. Ink form roller down
7. Stop
8. Folder engaged
9. Infeed engaged
10. Print
11. Print speed 0 to 30 to 0 iph Press runs are made using plates made from an ANPA test negative and a conventional negative, in this case, the front page of a newspaper. One of each plate is used with a protease solution of the invention and one each is used with the control solution.

EXPERIMENTAL FOUNTAIN SOLUTION - ANPA
DATA BASED ON NUMBER OF PRINTED COPIES FROM START-UP TO ACCEPTABLE IMAGE

| | | ANPA TEST NEGATIVE | | | | FRONT PAGE NEGATIVE | | | |
|---|---|---|---|---|---|---|---|---|---|
| % Protease in Fountain Solution | Conditions | Example | Control | Difference | % Fewer copies than Control | Example | Control | Difference | % Fewer copies than Control |
| 0.2 | Start-up #1 | 13 | 19 | 6 | 32 | 11 | 17 | 6 | 35 |
| 0.2 | Start-up #2 | 5 | 17 | 12 | 70 | 3 | 14 | 11 | 79 |
| 0.2 | Start-up #3 | 21 | 23 | 2 | 9 | 14 | 13 | −1 | −8 |
| 0.2 | Start-up #4 | 18 | 25 | 7 | 28 | 16 | 25 | 9 | 36 |
| 0.2 | Black-out #1 | 25 Faded | 53+ not acc. at 53 | 28+ | 53+ | 25 Faded | 34 | 9 | 26 |
| 0.2 | Start-up #5 Following #1 Black-out | 18 | 88+ not acc. at 88 | 70+ | 80+ | 18 | 31 | 13 | 42 |
| 0.2 | Black-out #2 | 23 | 45+ not acc. at 45 | 22+ | 49+ | 23 | 39 | 16 | 41 |
| 0.1 | Start-up #6 Following #2 Black-out | 43 | 41 | −2 | −5 | 41 | 27 | −14 | −52 |
| 0.1 & pH 3.0 | Start-up #7 | 15 | 33 | 18 | 55 | 17 | 25 | 8 | 30 |
| | Black-out | 25 | 38 | 13 | 34 | 21 | 27 | 6 | 22 |
| | Start-up | 17 | 36 | 19 | 53 | 17 | 23 | 6 | 26 |
| Total Averages Excluding Negative and Uncertain Values | | | | | 11 40% | 9.3 37% | | | |
| Average Deviation | | | | | 47% 41% | 28% 29% | | | |
| Average During Start-Ups Excluding Negative and Uncertain Values | | | | | 10.6 41% | 8.8 41% | | | |
| Average During Black-Outs Excluding Negative and Uncertain Values | | | | | 13 34% | 10 31% | | | |

What is claimed is:

1. In a method for lithographic printing wherein a lithographic printing plate having oleophilic and hydrophilic areas on the printing surface of the plate is contacted with ink and an aqueous fountain dampening solution during printing, the improvement comprising, as said fountain solution an aqueous solution containing a water-soluble hydrolase enzyme dissolved therein to improve printing quality and reduce the amount of fountain solution necessary to dampen the plate.

2. Method of claim 1 wherein the water soluble enzyme is selected from the group consisting of pepsin, lipase, protease, amylase, diastase, papain and rapidase.

3. Method of claim 1 wherein the water soluble enzyme is pepsin.

4. Method of claim wherein the fountain dampening solution contains 0.05 to 5 weight percent of said enzyme.

5. Method of claim 1 wherein the fountain dampening solution also comprises an effective amount of an alcohol.

* * * * *